US008267645B2

(12) United States Patent
Brunner et al.

(10) Patent No.: US 8,267,645 B2
(45) Date of Patent: Sep. 18, 2012

(54) SHAFTLESS CENTRIFUGAL PUMP

(75) Inventors: Christopher M. Brunner, Owasso, OK (US); Jason Ives, Broken Arrow, OK (US); David W. Chilcoat, Jenks, OK (US)

(73) Assignee: Baker Hughes Incorporated, Houston, TX (US)

( * ) Notice: Subject to any disclaimer, the term of this patent is extended or adjusted under 35 U.S.C. 154(b) by 524 days.

(21) Appl. No.: 12/534,046

(22) Filed: Jul. 31, 2009

(65) Prior Publication Data

US 2011/0027077 A1 Feb. 3, 2011

(51) Int. Cl.
*F04D 29/22* (2006.01)

(52) U.S. Cl. ..... 415/199.2; 415/901; 416/124; 416/198 A

(58) Field of Classification Search ..... 416/120, 416/124, 125, 198 R, 204 A, 198 A; 415/60, 415/66, 198.1, 199.1, 199.3, 199.4, 199.5, 415/901, 199.2
See application file for complete search history.

(56) References Cited

U.S. PATENT DOCUMENTS

| | | | | |
|---|---|---|---|---|
| 3,116,696 | A * | 1/1964 | Deters | 415/140 |
| 3,154,019 | A * | 10/1964 | Hoyt | 415/112 |
| 3,265,001 | A | 8/1966 | Deters | |
| 3,269,323 | A * | 8/1966 | Lung | 415/199.2 |
| 3,884,595 | A | 5/1975 | Herrick | |
| 3,918,831 | A * | 11/1975 | Grennan | 415/131 |
| 3,941,506 | A * | 3/1976 | Robb et al. | 416/244 A |
| 4,025,225 | A | 5/1977 | Durant | |
| 4,063,846 | A * | 12/1977 | Eagle | 415/199.2 |
| 4,120,606 | A | 10/1978 | Reiss | |
| 4,278,399 | A * | 7/1981 | Erickson | 415/199.1 |
| 4,483,660 | A | 11/1984 | Roberts | |
| 4,778,334 | A | 10/1988 | Medgyesy et al. | |
| 4,781,531 | A | 11/1988 | James | |
| 4,909,705 | A | 3/1990 | Katsura et al. | |
| 5,531,564 | A | 7/1996 | Anttonen et al. | |
| 6,000,915 | A | 12/1999 | Hartman | |
| 7,409,997 | B2 | 8/2008 | Gay et al. | |
| 2008/0031731 | A1 | 2/2008 | Orban et al. | |

* cited by examiner

*Primary Examiner* — Edward Look
*Assistant Examiner* — Liam McDowell
(74) *Attorney, Agent, or Firm* — Bracewell & Giuliani LLP

(57) ABSTRACT

A centrifugal pump has impellers that are not connected by a central shaft. More specifically, each of the impellers has a separate hub segment that interlocks with an adjacent hub segment from another impeller. The hub segments are rotated in unison with each other to rotate the impellers.

20 Claims, 6 Drawing Sheets

SHAFTLESS CENTRIFUGAL PUMP

BACKGROUND OF THE INVENTION

1. Field of the Invention

The present invention relates to an apparatus and method for manufacturing a centrifugal pump without a shaft. More specifically, the invention relates to a submersible centrifugal pump having multiple impellers, wherein the impellers interconnect and rotate together without the use of a central shaft.

2. Description of the Related Art

Electrical submersible pumps ("ESP") are used to pump wellbore fluids from the depths of the earth to the surface. A typical ESP has a motor, a seal section, and a pump. The motor rotates a shaft inside the seal section. The seal section shaft is connected to the pump. The ESP pump is typically an impeller pump having multiple stages. Each stage has an impeller and a diffuser. In operation, wellbore fluids enter the first impeller and are accelerated by centrifugal force out of the impeller into the adjacent diffuser. The diffuser reduces the velocity of the wellbore fluid, converts the high velocity to pressure, and directs the fluid into the next impeller. The pressure of the wellbore fluid is increased with each successive stage, until the fluid is discharged from the pump into tubing that carries the fluid to the surface.

A central pump shaft is connected to the seal section shaft. As the motor rotates, it ultimately causes the central pump shaft to rotate. The central pump shaft passes through each impeller. Keys or splines on the shaft engage corresponding slots on each impeller so that the impellers rotate with the shaft. Spacers are frequently required between the impellers so that the impellers are properly spaced to engage the diffusers.

Assembly of the pump can be time consuming and costly. The spacer lengths must be calculated, each of the impellers and spacers must be attached to the central pump shaft, and then the assembled central pump shaft, spacers, and impellers must be installed in the pump housing. It would be advantageous to eliminate the central pump shaft and spacers, thus reducing material costs and assembly time.

SUMMARY OF THE INVENTION

An electrical submersible pump ("ESP") comprises a pump, a seal section, and a motor. The ESP may be suspended from tubing in a wellbore, wherein it is submerged in wellbore fluid. Wellbore fluid is drawn into a pump inlet located on the pump and then pumped up through tubing to the surface.

The motor may be any type of motor including, for example, an electric motor. The shaft of the motor connects to a seal section shaft, which passes through the seal section to the base of the pump. The pump comprises a pump housing and impellers, diffusers, radial supports, a tension spring assembly, and a containment bearing located within the pump housing.

The pump housing is a cylindrical member that forms the outer housing of the pump. It contains and protects many of the pump components. A plurality of diffusers are located within the pump housing. Each diffuser has a central bore, and passages defined by vanes. The vanes extend helically outward from the bore of the diffuser. The cross sectional area of each passage increases as the passage extends upward and inward from the base of the diffuser. Fluid entering the diffuser at high velocity is slowed to a lower velocity but higher pressure by the time it exits the diffuser.

A downward facing interior shoulder below the diffuser vanes may have a thrust bearing washer for engaging an upper surface of the impeller located below the diffuser. A base of the diffuser may have interlocking members for engaging an interlocking member of an adjacent diffuser.

The upward facing edges of the diffuser vanes define a discharge surface. Fluid exiting the diffuser from the discharge surface moves into the impeller above the diffuser. The diffuser may have an impeller support surface on its sidewalls for engaging the lower edges of the next impeller.

The impeller is a rotating pump member that uses centrifugal force to accelerate fluids. Each impeller has a solid hub segment, which is a cylindrical member rotated about an axis of rotation. One end of the solid hub segment has a drive socket, which is a receptacle formed in the surface of the end.

A drive member may be located on the opposite end of the solid hub segment from drive socket. The drive member is generally shaped to fit inside drive socket of an adjacent solid hub segment such that when drive member rotates, it causes the adjacent drive socket to rotate. Some embodiments may have drive sockets located at both ends or drive members located at both ends.

Each impeller has vanes, which may be attached to the solid hub segment. In some embodiments, the impeller vanes and solid hub segment are formed of the same material. Vanes extend radially from the solid hub segment and may be normal to the solid hub segment or may extend at an angle. In some embodiments, the vanes are curved as they extend from solid hub segment. Passages are formed between surfaces of vanes.

The rear wall of the impeller forms an outer edge of the impeller. The rear wall may be attached to an edge of the vanes. In some embodiments, the rear wall is attached to the solid hub segment, either directly or via vanes. In some embodiments, the solid hub segment, vanes, and rear wall are all cast or manufactured as a single piece of material. The rear wall may have a lower lip for engaging an impeller support surface of the diffuser. The rear wall defines a passage extending from below the impeller into the passages formed between vanes.

Each impeller has a front wall that is located at the opposite end of vanes from the rear wall. The front wall may be attached to the vanes. The inner diameter of the front wall may contact the solid hub segment. The front wall may have a sealing surface for sealing against the bearing member of the diffuser.

A containment and support bearing ("top bearing") is located at one end of the pump housing. The top bearing may be a thrust bearing or any other type of bearing suitable to support the rotation of a plurality of impellers. The top bearing engages the first solid hub segment to allow rotation of the solid hub segment.

A tension spring assembly is attached to the top bearing. It includes a coil spring, which may be located coaxially with the first solid hub segment. In some embodiments, the inner diameter of the coil spring is larger than an outer diameter of the first solid hub segment, and the first solid hub segment passes through the coil spring. One end of the coil spring may engage a shoulder located on the top bearing. A second end of the coil spring may engage an upward facing shoulder on the first solid hub segment. The coil spring is compressed by the first solid hub segment and thus urges the first solid hub segment away from top bearing.

The top bearing and diffuser are placed in pump housing. The first solid hub segment and the first impeller segment, with the tension spring assembly, are placed in the pump housing, such that first impeller segment engages the diffuser and the tension spring assembly engages both the shoulder and the upward facing shoulder. Subsequent diffusers and impellers are alternatingly placed in the pump housing. A base is attached at the end of the pump housing opposite from the top bearing. The tension spring assembly compresses the impeller segments along the central axis, and the diffusers prevent radial movement of impellers.

BRIEF DESCRIPTION OF THE DRAWINGS

So that the manner in which the above-recited features, aspects and advantages of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
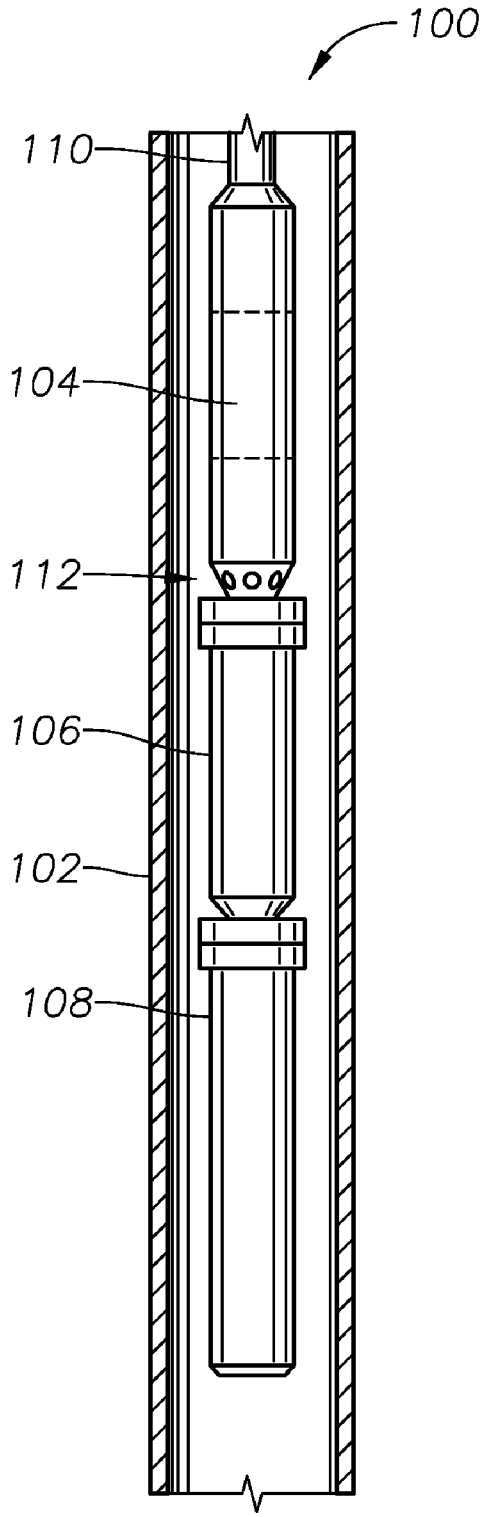
FIG. 1 is a side view of an electrical submersible pump assembly constructed in accordance with the invention and in a wellbore.

Referring to FIG. 1, electrical submersible pump ("ESP") 100 is located in wellbore 102. ESP 100 comprises pump assembly 104, seal section 106, and motor 108. ESP 100 may be suspended from tubing 110 in wellbore 102, wherein it is submerged in wellbore fluid. Wellbore fluid is drawn into pump inlet 112 on pump 104 and then pumped up to the surface through tubing 112.

Figure 2:
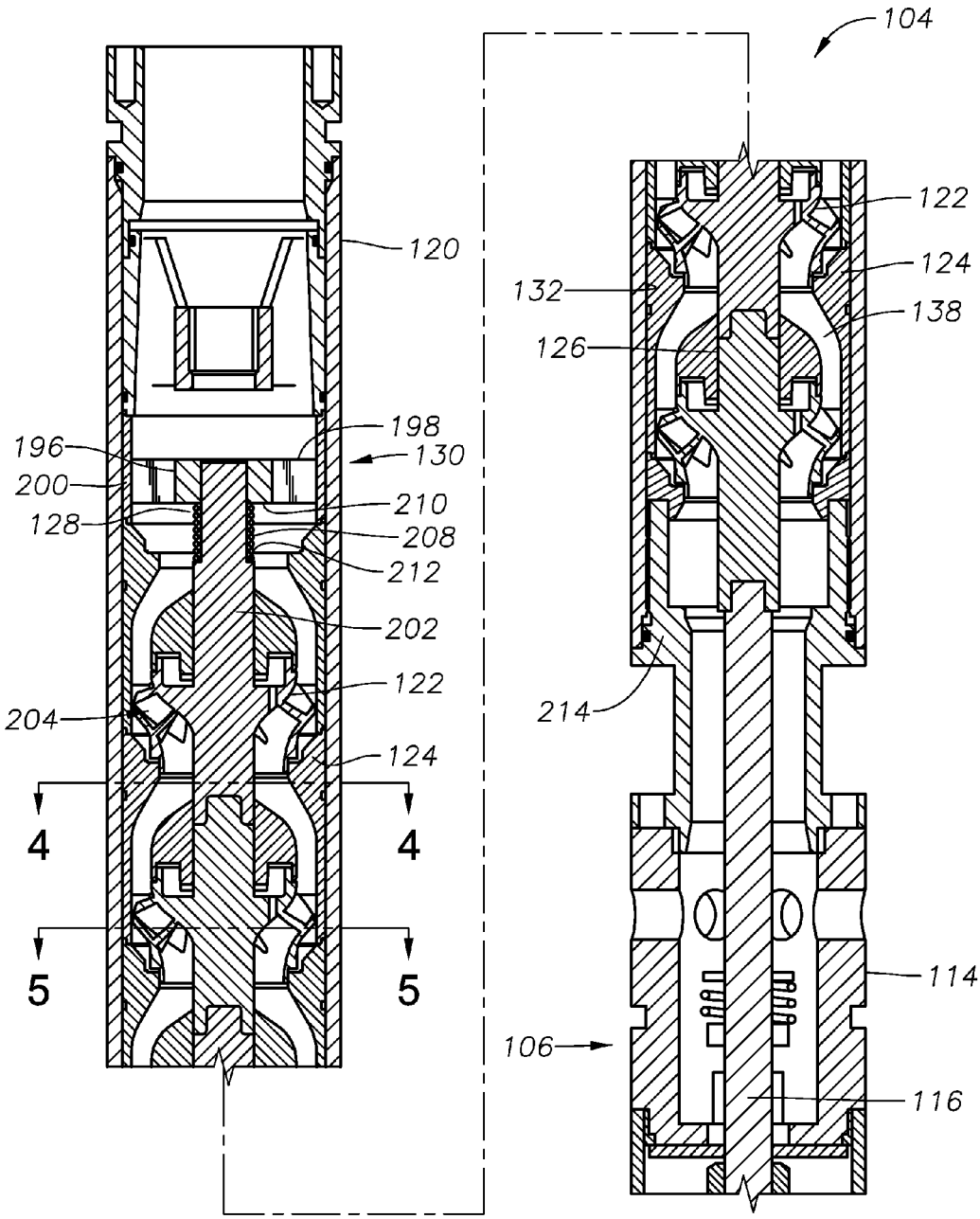
FIG. 2 is a sectional view of the electrical submersible pump of FIG. 1.
Figure 5:
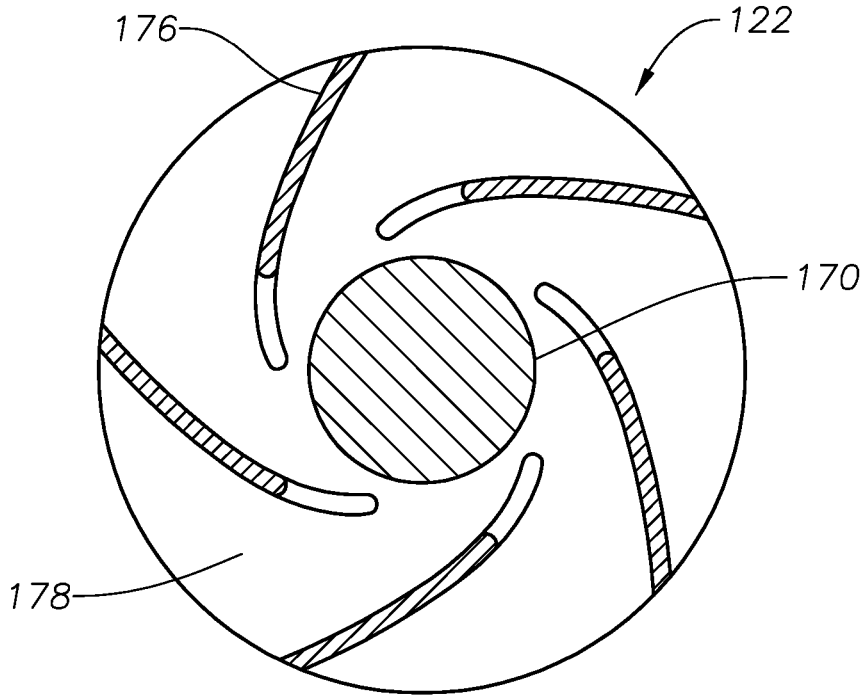
FIG. 5 is a cross-sectional view of one of the impellers of the pump of FIG. 2, taken along the 5-5 line.

Motor 108 may be any type of motor including, for example, an electric motor. Referring to FIG. 2, seal section 106 comprises seal section housing 114, seal section shaft 116, and means for equalizing pressure (not shown) of the lubricant in motor 108 with the hydrostatic fluid in wellbore 102. Motor 108 (FIG. 1) has a shaft (not shown) that connects to seal section shaft 116 (FIG. 5). Seal section shaft 116 passes through seal section 106 to the base of pump assembly 104. Pump assembly 104 comprises pump housing 120 and impellers 122, diffusers 124, radial supports 126, tension spring assembly 128, and containment bearing 130, all located within pump housing 120. Each of these components will be shown in greater detail in the following figures and described in greater detail in the accompanying text.

Pump housing 120 is a cylindrical member, having bore 132, that forms an exterior of pump assembly 104. Housing 120 may be made of metal, plastic, or any other suitably rigid material. Pump housing 120 contains and protects many of the components of pump assembly 104.

Figure 3:
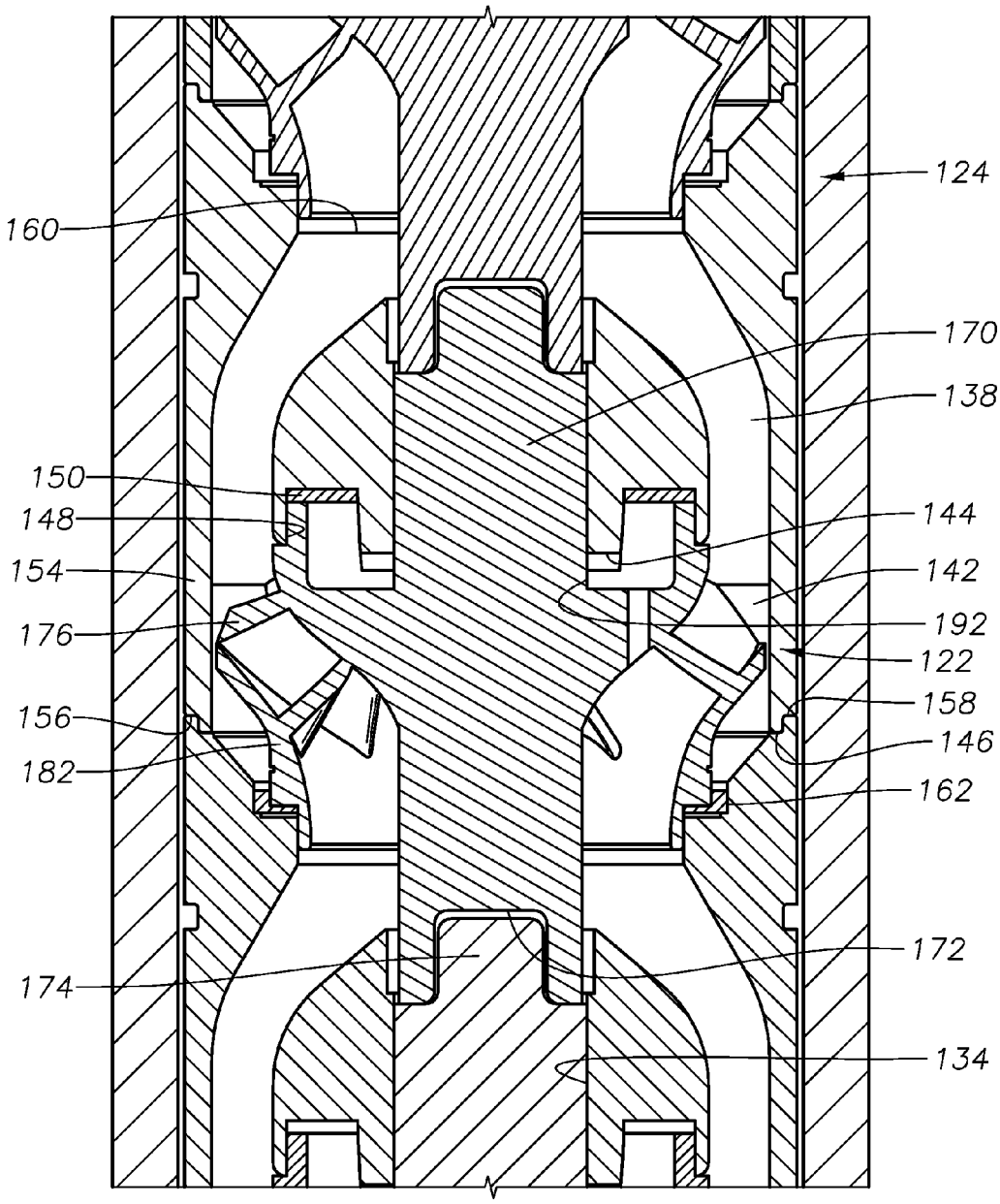
FIG. 3 is an enlarged sectional view of one stage of the pump of FIG. 2.

Referring to FIG. 3 diffusers 124 are stationarily located within pump housing 120. Each diffuser 124 has a generally cylindrical outer surface and an outer diameter sized to fit within the inner diameter of pump housing 120. Diffuser 124 has central bore 134 defined by its inner diameter.

Figure 4:
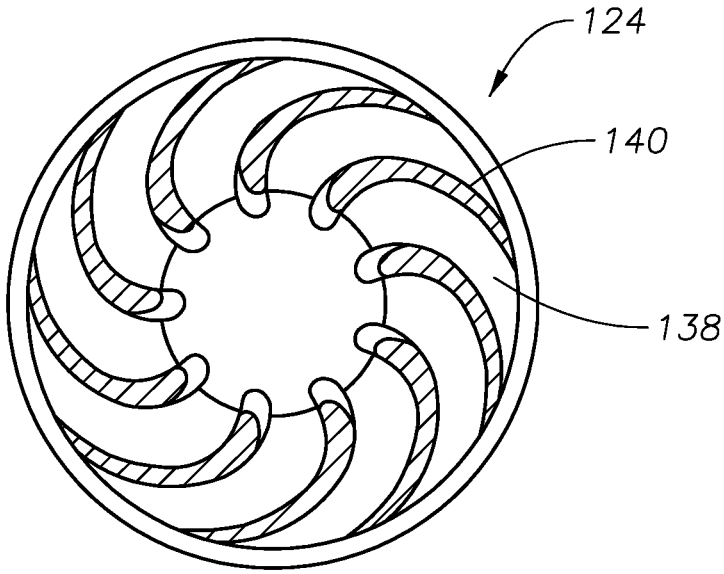
FIG. 4 is a cross-sectional view of one of the diffusers of the pump of FIG. 2, taken along the 4-4 line.

Each diffuser 124 contains a plurality of passages 138 that extend through diffuser 124. Referring to FIG. 4, each passage 138 is defined by vanes 140 that extend helically outward. Diffuser 124 may be a radial flow type, with passages extending outward in a radial plane or a mixed flow type, as shown, with passages extending axially and radially. Passages 138 generally flow from an outer radial location 142 near the base of diffuser 124 and then move inward, nearer the center of the diffuser, as the passage moves along the axial length of diffuser 124. The cross-sectional area of passages 138 also tends to increase as the passage 138 moves from the base of diffuser 124 toward the top of diffuser 124. Thus fluid entering passage 138 near the periphery of diffuser 124 at high velocity is slowed to a lower velocity, but higher pressure, as the fluid moves axially through passage 138.

The lower edges of diffuser vanes 140 define downward facing interior shoulder 144, which is recessed from lower edge 146 of diffuser 124, as shown in FIG. 3. Downward facing interior shoulder 144 may have annular groove 148 with bearing member 150, such as thrust bearing washer, located within annular groove 148.

Lower edge 146 of diffuser 124 forms a generally annular ring that defines a downward facing opening. Lower end 146 of diffuser sidewall 154 may have downward facing lower interlocking member 156, such as a shoulder or rabbet, for receiving a corresponding upper interlocking member 158 on the upper end of an adjacent diffuser 124.

The upward facing edges of diffuser vanes 140 (FIG. 4) define discharge surface 160. Discharge surface 160 may be a generally flat surface, having openings at each passage, that is perpendicular to the axis of diffuser 124. Diffuser sidewalls 154 have impeller support surface 162 which engages lower edges of impeller 122. Impeller support surface 162 may include thrust bearing washers to engage impeller in the axial direction. Impeller support surface 162 may also have radial support surfaces to support impeller 122 in the radial direction.

Referring still to FIG. 3, impeller 122 is a rotating pump member that uses centrifugal force to accelerate fluids. Impeller 122 has an solid hub segment 170, which is the central, cylindrical member about which impeller 122 rotates. Each impeller 122 comprises a separate solid hub segment 170. There is no central shaft running through pump housing 120.

One end of each solid hub segment 170 has drive socket 172, which is a receptacle formed in the surface of the end. Drive socket 170 may be any polygonal shape, including, for example, square, hexagonal, or octagonal. Drive socket has an axial depth sufficient to engage drive member 174.

Drive member 174 is located on the opposite end of solid hub segment 170 from drive socket 172. Drive member 174 is a geometric shape protruding from the end surface of solid hub segment 170. The geometric shape could be any polygonal shape, including, for example, square, hexagonal, octagonal. Drive member 174 is generally shaped to fit inside drive socket 172 of an adjacent solid hub segment 170 such that when drive member 174 rotates, it causes the adjacent drive socket 172 to rotate. Drive member 174 and drive socket 172 may be located on either end of solid hub segment 170, provided each drive member 174 or drive socket 172 is able to interlock with an adjacent drive socket 172 or drive member 174. Some embodiments may have drive socket 172 located at both ends or drive member 174 located at both ends. An adapter (not shown) may be used to facilitate the interlocking of members. The adapter (not shown) could be, for example, a key used to join two adjacent sockets 172, or the adapter could be a sleeve having two receptacles for joining two adjacent drive members 174.

Referring to FIG. 5, impeller vanes 176 may be attached to or integrally formed with solid hub segment 170. In some embodiments, impeller vanes 176 and solid hub segment 170 form a single integral component. In some embodiments, each of solid hub segment 170 has an axial length longer than an axial length of impeller vanes 176 to which the solid hub segment 170 is joined. Vanes 176 extend radially from solid hub segment 170 and may be normal to hub segment or may extend at an angle. In some embodiments, vanes 176 are curved as they extend from solid hub segment 170. Passages 178 are formed between surfaces of vanes 176.

Figure 6:
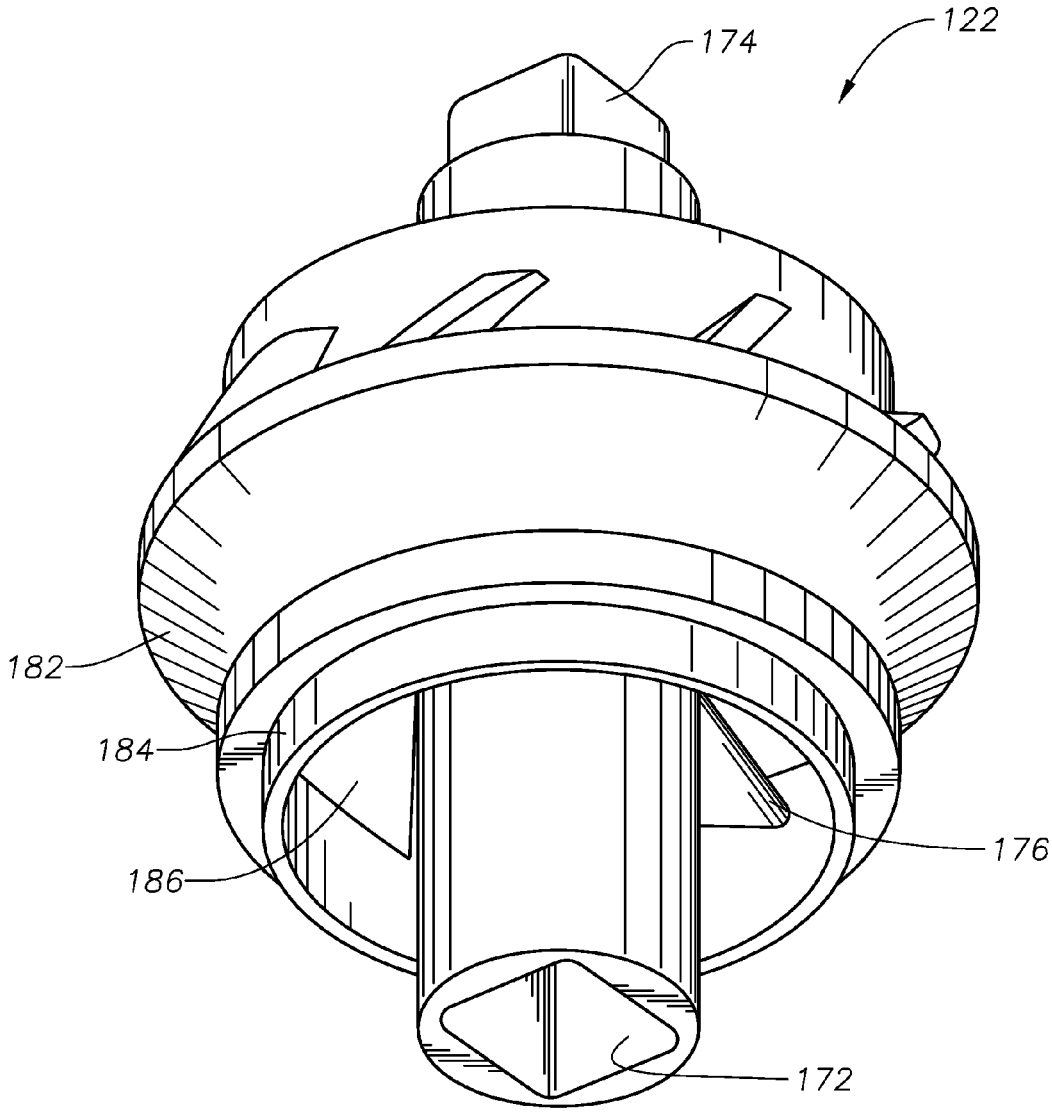
FIG. 6 is a perspective view showing the bottom of an impeller of the pump of FIG. 2.

Referring to FIG. 6, rear wall 182 forms an outer edge of impeller 122. Rear wall 182 may be attached to or join an edge of vanes 176. In some embodiments, rear wall is attached to solid hub segment 170, either directly or via vanes 176. In some embodiments, solid hub segment 170, vanes 176, and rear wall 182 are all cast or manufactured as a single piece of material.

Rear wall 182 may have lower lip 184 for engaging impeller support surface 162 of diffuser 124 (FIG. 3). Lower lip 184 may be formed on the bottom surface of rear wall 182, an outer diameter edge of rear wall 182, or both. Rear wall 182 defines passage 186 from below impeller 122 into the passages 178 formed between vanes 176.

Figure 7:
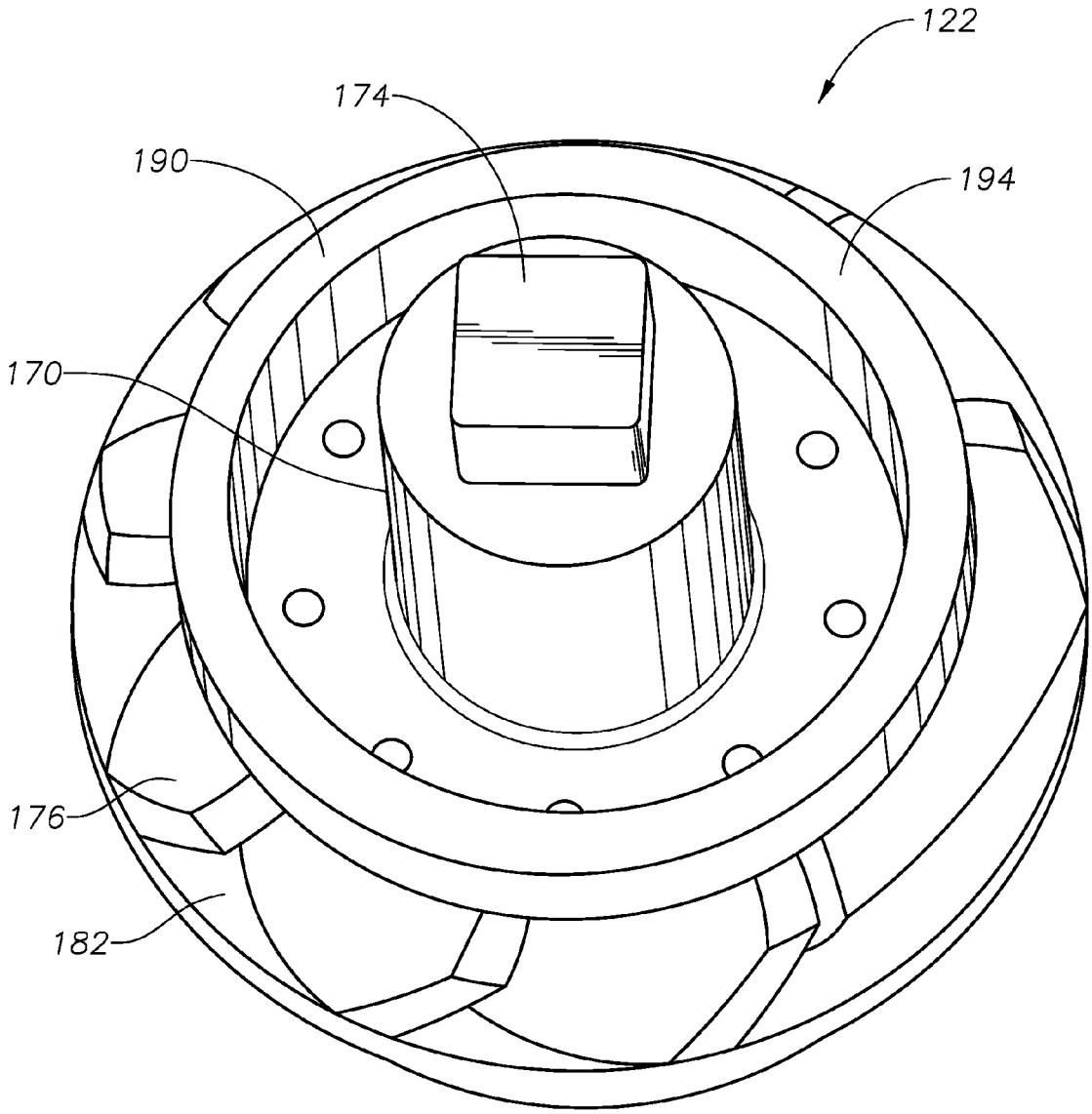
FIG. 7 is a perspective view showing the top of an impeller of the pump of FIG. 2.

Referring to FIG. 7, front wall 190 is located at the opposite end of vanes 176 from rear wall 182. Front wall 190 may be attached to or join vanes 176. Inner diameter 192 (FIG. 3) of front wall 190 may contact solid hub segment 170. Front wall 190 generally defines an upper boundary of passages 178 between vanes 176. Front wall may have sealing surface 194 for sealing against bearing member 150 of diffuser 124 (FIG. 3).

Referring back to FIG. 2, containment and support bearing assembly ("containment bearing") 130 is located at one end of pump housing 120. Containment bearing 130 may include bearing 196, spokes 198, and bearing support sleeve 200. Bearing 196 may be a thrust bearing or any other type of bearing suitable to support the rotation of a plurality of impellers 122. In an exemplary embodiment, bearing 196 may be supported by spokes 198. Spokes 198 extend radially from bearing 196 to bearing support sleeve 200. Bearing support sleeve 200 is a cylindrical sleeve with an outer diameter smaller than the inner diameter of pump housing 120. In some embodiments, bearing support sleeve 200, spokes 198, and the outer housing of bearing 196 may all be cast or otherwise integrally formed of the same material. In other embodiments, spokes 198 may be affixed to bearing support sleeve 200 or bearing 196 by a variety of attachment techniques including, for example, welding. Wellbore fluids are able to pass through the passage defined by bearing 196 and sleeve 200.

In some embodiments, first hub segment 202, which engages bearing assembly 130, is different than solid hub segment 170 (which may be used in subsequent impellers 122 within pump assembly 104). In some embodiments, first hub segment 202 is a member of first impeller segment 204, wherein vanes 176 extend from first hub segment 202. In other embodiments (not shown), first hub segment 202 may be a shaft segment operably connected to first hub segment 204 by, for example, a socket 172 and drive member 174, in which case first impeller 204 may be identical to subsequent impellers 122.

Tension spring assembly 128 is used to apply axial pressure on impellers 122 and thus keep sockets 172 and drive members 174 engaged while impellers 122 are rotating within pump housing 120. Tension spring assembly 128 includes coil spring 208. Coil spring 208 may be located coaxially with first hub segment 202. In some embodiments, the inner diameter of coil spring 208 is larger than an outer diameter of first hub segment 202, and first hub segment 202 passes through coil spring 208. One end of coil spring 208 may engage shoulder 210 located on containment bearing 130. A second end of coil spring 208 may engage an upward facing shoulder 212 on first hub segment 202. Coil spring 208 is compressed by first hub segment 202 and thus urges first hub segment 202 away from containment bearing 130.

Containment bearing 130 and diffuser 124 are placed in pump housing 120. First hub segment 202 and first impeller segment 204, with tension spring assembly 128, are placed in pump housing 120, such that first impeller segment 204 engages diffuser 124 and tension spring assembly engages both shoulder 210 and upward facing shoulder 212. Subsequent diffusers 124 and impellers 122 are alternatingly placed in pump housing 120. Base 214 is attached at the end of pump housing 120 opposite from containment bearing 130. Tension spring assembly 128 compresses impeller segments along the central axis, and diffusers 124 prevent radial movement of impellers 122.

In operation, motor 108 rotates motor shaft (not shown), which in turn causes seal section shaft 116 to rotate. Seal section shaft 116 engages solid hub segment 170 of the bottom-most impeller 122. Rotational force is transferred via drive sockets 172 and drive members 174 of each solid hub segment 170, thus causing all impellers 122 to rotate together. Tension spring assembly 128 urges impellers 122 to remain engaged while rotating. Impeller support surface 162 engages the lower lip of rear wall 182 to prevent radial dislocation of impellers 122 during rotation. Wellbore fluid entering pump inlet 112 is drawn into passage 178 of impeller 122. The rotation of impeller 122 accelerates fluid out of passage 178 into diffuser passage 138. In diffuser passage 138, the fluid velocity is decreased and pressure is increased. The fluid exits diffuser passage 138, passing through the opening defined by rear wall 182 as it enters the next impeller 122. The wellbore fluid continues to pass through each subsequent diffuser 124 and impeller 122 until it reaches tubing 110, wherein it is propelled up through tubing 110.

While the invention has been shown or described in only some of its forms, it should be apparent to those skilled in the art that it is not so limited, but is susceptible to various changes without departing from the scope of the invention.

What is claimed is:

1. A centrifugal pump assembly comprising:

a motor assembly;

a pump housing connected to the motor assembly;

a first diffuser and a second diffuser located within the pump housing;

a first impeller axially centered within the first diffuser, the first impeller having a first hub segment and first plurality of vanes attached to the first hub segment;

a second impeller axially centered within the second diffuser, the second impeller having a second hub segment and second plurality of vanes attached to the second hub segment, the second impeller being located further from the motor assembly than the first impeller;

wherein each of the first hub segment and the second hub segment has a drive member and a driven member, the drive member of the first hub segment being operably and detachably connected to the driven member of the second hub segment, such that when the first hub segment rotates about an axis, it causes the second hub segment to rotate about the same axis; and a shaft extending from the motor assembly, into the pump housing, coupling to and terminating at the driven member of the first hub segment.

2. The centrifugal pump assembly according to claim 1, wherein the first hub segment and the first plurality of vanes are formed from a single piece of material.

3. The centrifugal pump assembly according to claim 1, wherein the first hub segment and the second hub segment are solid.

4. The centrifugal pump assembly according to claim 3, wherein each of the drive member and the driven member of each of the first hub segment and the second hub segment spans a radial center of respective hub segments.

5. The centrifugal pump assembly according to claim 1, wherein the first and second diffusers have bores, the first hub segment having a first end terminating in the bore of the first diffuser and a second end terminating in the bore of the second diffuser.

6. The centrifugal pump assembly according to claim 1, further comprising a spring located at an end of the pump housing, wherein the spring urges the second impeller toward the first impeller.

7. The centrifugal pump assembly according to claim 1, wherein the first impeller comprises an annular inlet surrounding the first hub segment.

8. The centrifugal pump assembly according to claim 1, wherein the first hub segment has an end that engages an end of the second hub segment, one of the ends being a polygonal socket and the other a polygonal drive member inserted into the socket to transmit rotation.

9. The centrifugal pump assembly according to claim 1, wherein the centrifugal pump has an absence of a central shaft extending through the first and second impellers.

10. A centrifugal pump assembly, comprising:

a motor assembly comprising a motor, a seal section, and a shaft extending therefrom;

a pump housing connected to the motor assembly;

a plurality of diffusers stationarily mounted within the pump housing in abutment with each other;

a plurality of impellers, a respective one of the impellers axially centered within a corresponding one of the diffusers for rotation relative to the diffusers, each of the impellers comprising a hub segment and a set of vanes, the set of vanes and the hub segment being joined together so as to be axially and rotationally movable in unison with each other; and each hub segment having a drive socket on one end and a drive member on an opposite end, the shaft terminating in and connecting to the drive socket of the impeller located nearest the motor assembly and each subsequent drive socket being in engagement with the drive member of an adjacent impeller for transmitting rotation.

11. The centrifugal pump assembly according to claim 10, wherein each impeller is axially fixed relative to one of the diffusers.

12. The centrifugal pump assembly according to claim 10, wherein each diffuser has an upper impeller support surface that engages a surface on one of the impellers and a lower impeller support surface that engages a surface on an adjacent one of the impellers.

13. The centrifugal pump assembly according to claim 10, wherein the centrifugal pump has an absence of a central shaft extending through the impellers.

14. The centrifugal pump assembly according to claim 10, further comprising a tension spring assembly at one end of the pump, wherein the tension spring assembly engages one of the hub segments, thereby urging the hub segments toward each other.

15. The centrifugal pump assembly according to claim 10, wherein the drive socket and the drive member of each of the hub segments are polygonal.

16. The centrifugal pump assembly according to claim 10, wherein each of the hub segments is solid.

17. A centrifugal pump, comprising:

a pump housing having a lower end and an upper end;

a plurality of diffusers stationarily mounted within the pump housing in abutment with each other;

a plurality of impellers, a respective one of the impellers axially centered within a corresponding one of the diffusers for rotation relative to the diffusers, each of the impellers comprising a hub segment, a set of vanes, the set of vanes and the hub segment being formed from a single piece of material, and an annular inlet surrounding the hub segment, the impellers being free of a shaft extending therethrough;

a spring located at a first end of the pump housing, wherein the spring urges the impellers toward each other; and each hub segment having an upper drive member on one end and a lower drive member on an opposite end, the lower drive member on the hub segment of the lowermost impeller being adapted to engage an upper end of a shaft from a motor, and each upper drive member being in engagement with the lower drive member of an adjacent impeller for transmitting rotation.

18. The centrifugal pump according to claim 17, wherein each of the hub segments is solid.

19. The centrifugal pump according to claim 17, wherein each of the diffusers have bores, and wherein the lower drive member of each hub segment is located within the bore of one of the diffusers and the upper drive member of each hub segment is located within an adjacent diffuser.

20. The centrifugal pump according to claim 17, each of the hub segments has an axial length longer than an axial length of the set of vanes of the impeller to which it is joined.

* * * * *